United States Patent [19]

Guild

[11] 4,075,859

[45] Feb. 28, 1978

[54] COMPOSITE PILE AND TAPERED CONCRETE TIP THEREFOR

[76] Inventor: Charles L. Guild, 7 Stone Tower Lane, Barrington, R.I. 02806

[21] Appl. No.: 704,427

[22] Filed: Jul. 12, 1976

[51] Int. Cl.[2] ..... E02D 5/30; E02D 5/72

[52] U.S. Cl. ..... 61/53; 61/53.52; 61/56

[58] Field of Search ..... 61/53.3, 53.5, 53.52, 61/56, 56.5, 53.64, 53.60, 53.6; 52/170, 710

[56] References Cited

U.S. PATENT DOCUMENTS

| | | | |
|---|---|---|---|
| 2,011,459 | 8/1935 | Snow et al. | 61/56 |
| 2,065,507 | 12/1936 | Alexander | 61/56 |
| 3,316,723 | 5/1967 | Schutte | 61/53.66 X |
| 3,916,635 | 11/1975 | Lynch et al. | 61/53 |
| 3,971,227 | 7/1976 | Godley | 61/56.5 |
| 4,012,915 | 3/1977 | Poma | 61/53 |

*Primary Examiner*—Jacob Shapiro

[57] ABSTRACT

A composite pile includes a tubular pile and a tapered, reinforced concrete tip having a central passage opening through its larger upper end and a seat exposed in its bottom. The passage is of a cross sectional area greater than that of the pile and freely receives the boot end thereof. With the boot end of the pile in engagement with the seat the pile is secured thereto in a centered position once the space between the pile and the wall of the passage is filled with a suitable packing.

6 Claims, 4 Drawing Figures

COMPOSITE PILE AND TAPERED CONCRETE TIP THEREFOR

BACKGROUND REFERENCES

"Construction Methods & Equipment" May 1957, Pages 218, 219, 221, 224
"The Boston Sunday Globe" — May 4, 1958 "MDC Road To Ease Charles Traffic"
"The Boston Sunday Globe" — Feb. 21, 1957 "MDC Eliminating Memorial Drive Accident Producing Bottleneck"
U.S. Pat. No. 1,778,925
U.S. Pat. No. 3,751,931
U.S. Pat. No. 3,875,752
U.S. Ser. No. 629,508, filed Nov. 6, 1975

BACKGROUND OF THE INVENTION

Composite piles having a tapered, reinforced concrete tip are, under certain conditions, used to advantage.

Such tips commonly have a tubular core extending lengthwise centrally of the tip and opening through its larger upper end to receive the boot end of the mandrel and with the core provided with an upper portion disposed and dimensioned to enable a tubular pile to be connected thereto.

Composite piles including such tips, are capable of being driven as readily as other piles and are adapted to meet installation requirements under some soil conditions better than such other piles, but tip costs and the connection of the piles to the tips are factors that merit attention.

THE PRESENT INVENTION

The general objective of the present invention is to provide a composite pile including a main pile portion and a tapered concrete tip therefor that will enable costs to be minimized, an objective attained by providing a composite pile having a tubular main pile portion provided with a boot at its lower end and a tapered reinforced concrete tip, formed with a central passageway opening through its larger, upper end and having a seat exposed at the bottom thereof. The passage is dimensioned to freely receive the boot end of the tubular pile and to permit the boot to engage the seat. The pile is securely connected to the tip once the space remaining between the boot end of the tubular pile is suitably packed with sand or other materials that are non-corrosive, have no adverse effect on concrete, and, preferably, set quickly.

Other objectives of the invention relating to the composite pile and its tip will be apparent from the description of the preferred embodiment and the appended claims.

BRIEF DESCRIPTION OF THE DRAWINGS

A preferred embodiment of the invention is illustrated with the accompanying drawings of which

THE PREFERRED EMBODIMENT OF THE INVENTION

Figure 1:
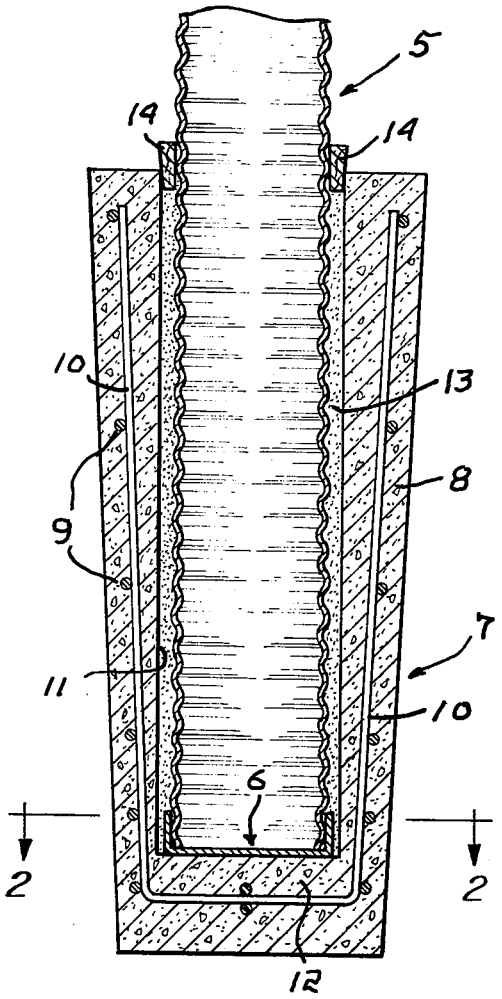
FIG. 1 is a vertical section through the lower part of a composite pile in accordance with the invention, the main portion being a corrugated shell.
Figure 2:
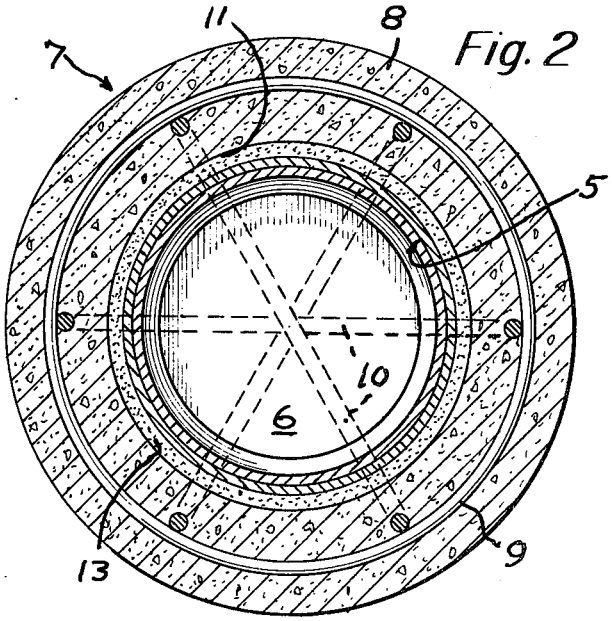
FIG. 2 is a section, on an increase in scale, taken approximately along the indicated line 2—2 of FIG. 1.

In the embodiment of the invention illustrated by FIGS. 1 and 2, a composite pile includes a tubular main pile portion 5 that is a corrugated shell having a boot 6 secured to its lower end and a tapered, reinforced concrete tip generally indicated at 7.

The reinforcement of the concrete body 8 of the tip 7 includes circular members 9 welded to a series of vertically disposed members 10 surrounding a central passage 11 formed in and extending part way through the body 8 from its larger upper end. The passage 11, desirably and as shown, extends close to the lower end of the tip and, in practice, the members 10 are U-shaped thus to include portions extending transversely through the relatively thin concrete layer that constitutes the seat 12 engageable by the boot 6 of the pile 5. In practice, the thickness of the seat 12 is in the approximate range of from 10 - 20% of the length of the tip.

In accordance with the invention, the cross sectional area of the passage 11 is enough greater than that of the pile shell 5 so that the pile 5 is a loose fit therein and is secured to the tip 7 by a packing 13, the centering of the pile 5 first effected by means of wedges 14 which usually are removed once the annular space surrounding the pile shell 5 is packed. In practice, the inside diameter of the passage 11 is in the approximate range of from three quarters to an inch greater than the maximum diameter of the boot 6.

The packing may be sand, cement, grout, an epoxy cement or any material that will set in a short time and is non-corrosive and is one having no adverse effect on concrete.

Figure 3:
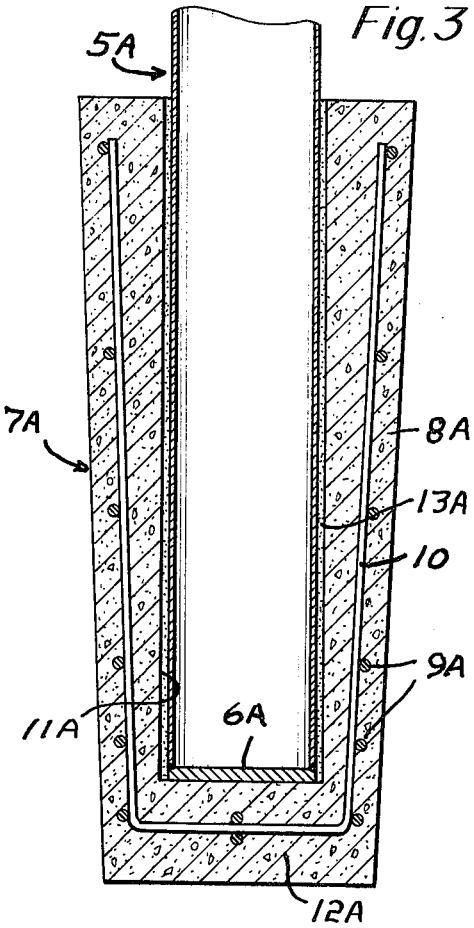
FIG. 3 is a view, similar to FIG. 1 but with the main pile portion a pipe.

The embodiment of the invention illustrated by FIG. 3 is generally similar to that just described and accordingly corresponding parts are identified by the appropriate reference numerals which are distinguished by the suffix addition A. In FIG. 3, the main pile portion is a pipe 5A having an end plate 6A welded to the lower end thereof, the outside diameter of the end plate the same as that of the pipe 5A and the inside diameter of the passage 11A in the approximate range of from three-quarters to an inch greater than the outside diameter of the pipe 5A.

Figure 4:
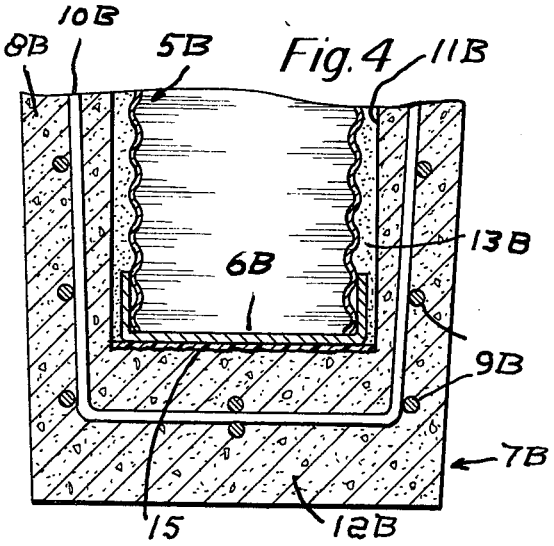
FIG. 4 is a fragmentary vertical section of the top end of a composite pile with an insert overlying the bottom of the central passage.

In FIG. 4 a fragment of a tapered concrete tip is shown and as it is or may be identical to that of FIGS. 1 and 2 corresponding parts are indicated by the appropriate reference numerals to which the suffix addition B has been added. A tubular main pile portion 5B is shown with an insert or pad 15 on the seat 12 that is capable of absorbing some of the hammer energy and thus protect the relatively thin seat from possibly being cracked and at the same time enabling any unevenness of the seat 12, the boot 6, or end plate 6A to be compensated for by a disk of Micarta or the equivalent, by way of example, either simply flush against the seat or secured to the closed end of the pile.

I claim:

1. A composite pile comprising a tubular pile including a member closing its bottom end, a tapered, reinforced concrete tip, its larger end the upper end, said tip having a central, upwardly opening lengthwise passage and a seat exposed at the bottom of said passage, the cross sectional area and depth of the entire length of the passage being such as to accommodate the bottom end of the pile as a free fit therein with the pile-closing member resting on said seat, and means interposed between said tip and said pile end centering said pile end in said passage and including a fluent body substantially filling the space between said pile end and said tip to complete and ready said pile for driving and to maintain the pile and tip concentric throughout the driving of said pile.

2. The composite pile of claim 1 in which the fluent body is a packing.

3. The composite pile of claim 2 in which the fluent body is sand.

4. The composite pile of claim 2 in which the fluent body is cement grout.

5. The composite pile of claim 2 in which the fluent body is epoxy cement.

6. The composite pile of claim 1 in which the centering means includes wedges.

* * * * *